US005494554A

United States Patent [19]

Edwards et al.

[11] Patent Number: 5,494,554

[45] Date of Patent: Feb. 27, 1996

[54] METHOD FOR MAKING SOFT LAYERED TISSUES

[75] Inventors: Steven L. Edwards, Fremont, Wis.; Peter J. Allen, Fullerton, Calif.; Oliver P. Renier, Green Bay, Wis.

[73] Assignee: Kimberly-Clark Corporation, Neenah, Wis.

[21] Appl. No.: 220,338

[22] Filed: Mar. 30, 1994

Related U.S. Application Data

[63] Continuation-in-part of Ser. No. 25,008, Mar. 2, 1993, abandoned.

[51] Int. Cl.[6] ..... B31F 1/12; D21H 27/30

[52] U.S. Cl. ..... 162/111; 162/123; 162/125; 162/130; 162/129; 162/132

[58] Field of Search ..... 162/123, 125, 162/129, 111, 130, 132

[56] References Cited

U.S. PATENT DOCUMENTS

| | | | |
|---|---|---|---|
| 3,994,771 | 11/1976 | Morgan, Jr. et al. | 162/113 |
| 4,112,167 | 9/1978 | Dake et al. | 162/113 |
| 4,166,001 | 8/1979 | Dunning et al. | 161/111 |
| 4,225,382 | 9/1980 | Kearney et al. | 162/111 |
| 4,300,981 | 11/1981 | Carstens | 162/109 |
| 4,381,219 | 4/1983 | Bubik et al. | 162/299 |
| 4,543,162 | 9/1985 | Hildebrand | 162/343 |
| 4,684,439 | 8/1987 | Soerens | 162/111 |
| 4,824,524 | 4/1989 | Hildebrand | 162/343 |
| 5,102,501 | 4/1992 | Eber et al. | 162/129 |
| 5,129,988 | 7/1992 | Farrington, Jr. | 162/123 |
| 5,133,836 | 7/1992 | Allen | 162/343 |

FOREIGN PATENT DOCUMENTS

| | | | |
|---|---|---|---|
| 0003377 | 8/1979 | European Pat. Off. . | |
| 0529174 | 3/1993 | European Pat. Off. | D21F 1/02 |

*Primary Examiner*—David L. Lacey
*Assistant Examiner*—Dean T. Nguyen
*Attorney, Agent, or Firm*—Gregory E. Croft

[57] ABSTRACT

The formation of wet-pressed tissue webs useful for facial tissue, bath tissue, paper towels or the like is substantially improved by forming the wet tissue web in layers in which the second-formed layer has a consistency which is significantly less than the consistency of the first-formed layer. The fiber support index of the forming fabric is about 170 or greater. The resulting improvement in web formation enables uniform debonding during creping, which in turn provides a significant improvement in softness and a reduction in linting. Wet-pressed tissues made with this process are uniformly internally debonded, as measured by a high Void Volume Index, which is comparable to that of through-dried tissues.

23 Claims, 6 Drawing Sheets

METHOD FOR MAKING SOFT LAYERED TISSUES

This application is a continuation-in-part of U.S. patent application Ser. No. 08/025,008 filed Mar. 2, 1993 now abandoned.

BACKGROUND OF THE INVENTION

The use of layering to make tissue products such as facial and bath tissue is well known in the art. Layering affords an opportunity to more precisely engineer the tissue by placing different fibers in the inner and outer layers to take advantage of the different properties that the different fibers offer. Because improving softness is frequently an objective for many tissue products, it is logical to place the softer fibers in the outer layers while other fibers occupy the center of the tissue. Eucalyptus fibers are well known for their softness properties, in part due to their short fiber length. However, increasing the short fiber content of the outer layers of tissues often leads to excessive linting, which is undesirable and is a common complaint among soft tissue users. In addition, merely providing a high level of short fibers in the outer layer of a tissue does not, by itself, ensure that a soft tissue will result. Particularly for wet-pressed tissues, obtaining softness equivalent to throughdried products is an unmet objective. Hence there is a need for a method of making softer tissues, particularly softer wet-pressed tissues, preferably with a lesser tendency to produce lint.

SUMMARY OF THE INVENTION

It has now been discovered that the softness and bulk of wet-pressed tissues can be greatly improved by forming the tissue web more uniformly and thereafter creping the tissue web in a particular manner. The softness and bulk of the resulting wet-pressed tissues are equivalent to that of throughdried tissues, which enables tissue manufacturers having wet-pressing assets to produce higher quality tissue products without incurring the capital expense of purchasing and operating throughdryers. While particularly advantageous for a wet-pressing process, the method of this invention can also be used for throughdrying processes as well. In addition, the forming and creping aspects of this invention can be applied to making blended as well as layered tissue products.

More specifically, it has been found that the formation of a layered tissue can be greatly improved by adjusting the relative consistencies of the stock layers as the tissue sheet is formed such that the consistency of one or more of the second, third, fourth, etc. stock layers is (are) less than the consistency of the first layer. (As defined herein, the "first" stock layer is the only stock layer which comes in direct contact with the forming fabric or is the first to come in direct contact with the forming fabric, as the stock jet is deposited onto the forming fabric. Also as used herein, "consistency" is the weight percent fiber in an aqueous fiber suspension, a stock layer, or a dewatered or dried web.) Preferably, the consistency of successive stock layers is progressively less. It has been found that the resulting tissues have substantially better overall formation, as measured by the Formation Index (hereinafter defined), and correspondingly have substantially better softness. Formation improvements, as measured by the Formation Index, can be about 15 percent or greater as compared to the same tissue sheet made with all stock layers having the same consistency.

In addition to properly adjusting the consistencies of the stock layers, or when making a blended (not layered) tissue sheet, selecting a forming fabric having a very high fiber support index while providing high drainage rates has been found to provide a much improved balance of strength and stiffness. Normally, a plot of tissue stiffness as a function of strength (geometric mean tensile strength) yields an upwardly sloping line reflecting that an increase in strength results in an increase in stiffness. While increased strength is desireable, the corresponding increase in stiffness is not because increasing stiffness correlates with decreasing softness. It has been found that by increasing the fiber support index of the forming fabric, the slope of the stiffness vs. strength curve can be substantially flattened, almost to the point where stiffness is independent of strength (see FIG. 6). Hence, by using high fiber support index forming fabrics, tissues having high strength and low stiffness can be made.

Lastly, a particular method of creping has been found to be advantageous, particularly when used in combination with one or both of the foregoing aspects of improved formation, in order to provide the uniformly and highly debonded products of this invention. More specifically, it has been found that the use of certain creping adhesives in combination with high dryer temperatures that cause the web to be creped at very low moisture levels greatly improves the softness and internal debonding of the tissue relative to wet-pressed tissue products produced by conventional creping.

Hence in one aspect the invention resides in a method of making a soft tissue comprising: (a) forming a wet tissue web using a layered headbox in which first and second stock layers having different consistencies, separated by a headbox divider, are continuously deposited onto an endless forming fabric having a fiber support index of about 170 or greater to form a wet web such that the second stock layer is superposed on top of the first stock layer and the first stock layer directly contacts the forming fabric, wherein the ratio of the consistency of the second stock layer to the consistency of the first stock layer is about 0.95 or less; (b) drying the web to a consistency of 97 percent or greater at a web temperature of about 200° F. or greater; and (c) creping the dried web.

In another aspect, the invention resides in a method for making a soft tissue comprising: (a) forming a wet tissue web using a layered headbox in which first and second stock layers having different consistencies, separated by a headbox divider, are continuously deposited onto an endless forming fabric having a fiber support index of about 170 or greater to form a wet web such that the second stock layer is superposed on top of the first stock layer and the first stock layer directly contacts the forming fabric, wherein the ratio of the consistency of the second stock layer to the consistency of the first stock layer is about 0.95 or less; (b) carrying the wet tissue web on a papermaking felt and pressing the wet web between the felt and the surface of a dryer coated with a creping adhesive to a partially dewater the web and adhere it to the surface of the dryer; (c) drying the dewatered web to a consistency of 97 percent or greater at a web temperature of about 200° F. or greater; and (d) creping the dried web.

In another aspect, the invention resides in a method of making a soft, blended, wet-pressed tissue comprising forming a wet tissue web by depositing an aqueous suspension of papermaking fibers onto a forming fabric having a fiber support index of about 170 or greater; (b) carrying the wet tissue web on a papermaking felt and pressing the wet web between the felt and the surface of a dryer coated with a creping adhesive to partially dewater the web and adhere it to the surface of the dryer (c) drying the web to a consistency of 97 percent or greater at a web temperature of about 200° F. or greater; and (d) creping the dried web.

In another aspect, the invention resides in a soft wet-pressed tissue which is very uniformly formed and very uniformly debonded. These tissues can be characterized by a Formation Index of about 150 or greater, suitably from about 150 to about 250, and more specifically from about 160 to about 200. Such a tissue can be further characterized by a high Void Volume (hereinafter defined), which for wet-pressed tissues can be raised to levels heretofore associated only with throughdried tissues. More specifically, the Void Volume of the wet-pressed tissues of this invention can be about 9 or greater, preferably about 10 or greater, and suitably from about 9 to about 12. Also, the bulk of the wet pressed tissues of this invention can be about 9 cubic centimeters per gram or greater as determined by the caliper divided by the basis weight. Caliper is the thickness of a single sheet, but measured as the thickness of a stack of ten sheets and dividing the ten sheet thickness by ten, where each sheet within a stack is placed with the same side up. It is measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is a Bulk Micrometer (TMI Model 49-72-00, Amityville, N.Y.) having an anvil diameter of 4 1/16 inches (103.2 millimeters) and an anvil pressure of 220 grams per square inch (3.39 kiloPascals). After the caliper is measured, the same ten sheets are used to determine the average basis weight of the sheets.

In practicing the forming aspect of the method of this invention, the ratio of the consistency of the second stock layer to that of the first stock layer can more specifically be from about 0.7 to about 0.1 or less, and still more specifically from about 0.5 to about 0.1 or less. A particularly suitable range is from about 0.3 to about 0.5.

The fiber support index of the forming fabric, which is a well known concept within the paper industry, can be greater about 170 or greater, more specifically about 220 or greater, and still more specifically from about 170 to about 270 or more. The concept of the fiber support index is described in a paper by Robert L. Beran, "The Evaluation and Selection of Forming Fabrics", Tappi, Vol. 62, No. 4 (April 1979), which is herein incorporated by reference. To adapt the Beran formula to multilayer fabrics it is necessary to determine the smallest repeating unit of the surface of the fabric that touches the sheet. Once the smallest repeating unit is determined, then the formula of Beran applies.

With regard to the creping aspect of the method of this invention, suitable creping adhesives comprise an aqueous solution of a plasticizer and a thermosetting cationic polyamide resin, and preferably further comprise polyvinyl alcohol. The creping adhesive is applied as a solution containing from about 0.1 to about 1 percent solids, the balance being water.

Suitable thermosetting cationic polyamide resins are the water-soluble polymeric reaction product of an epihalohydrin, preferably epichlorohydrin, and a water-soluble polyamide having secondary amine groups derived from polyalkylene polyamine and a saturated aliphatic dibasic carboxylic acid containing from about 3 to 10 carbon atoms. The water soluble polyamide contains recurring groups of the formula:

$$-NH(C_nH_{2n}HN)_x-CORCO-$$

where n and x are each 2 or more and R is the divalent hydrocarbon radical of the dibasic carboxylic acid. An important characteristic of these resins is that they are phase compatible with polyvinyl alcohol. Suitable materials of this type are commercially available under the trademarks KYMENE® (Hercules, Inc.) and CASCAMID® (Borden) and are more fully described in U.S. Pat. No. 2,926,116 issued to Gerald Keim on Feb. 23, 1960, U.S. Pat. No. 3,058,873 issued to Gerald Keim et al. on Oct. 16, 1962, and U.S. Pat. No. 4,528,316 issued to Dave Soerens on Jul. 9, 1985, all of which are herein incorporated by reference. The creping adhesive also preferably includes polyvinyl alcohol. The amount of the thermosetting cationic polyamide resin in the creping composition, on a solids weight percent basis, can be from about 10 to about 80 percent, more specifically from about 20 to about 60 percent.

Suitable plasticizers include quaternized polyamino amides and sorbitol, although the plasticizing mechanism of sorbitol is likely different than that of the quaternized polyamino amides. A preferred quaternized polyamino amide is Quaker 2008, commercially available from Quaker Chemical Company. A significant amount of this plasticizer must be included in the creping composition in order to prevent the tissue sheet from wrapping around the dryer and to substantially prevent fibers from building up on the dryer surface. Suitable amounts of plasticizer in the creping adhesive composition can be from about 10 to about 40 weight percent, more specifically from about 15 to about 25 weight percent, on a solids basis.

When present, the amount of polyvinyl alcohol can be from about 1 to about 80 weight percent, more specifically from about 20 to about 60 weight percent on a solids basis.

The dryer temperature is such that the tissue is creped from the dryer surface as dry as possible. The temperature of the tissue web when it reaches the creping blade, as measured by an infra-red temperature sensor, is about 200° F. or greater, preferably about 220° F. or greater, and more preferably about 235° F. A suitable range is from about 225° F. to about 235° F. At the same time, the moisture content of the web at the creping blade is about 3 percent or less, preferably 2.5 percent or less. A suitable range is from about 2 to 3 percent. These conditions provide for very high adhesion of the web to the dryer surface and thereby enable the creping blade to uniformly debond the sheet, as measured by the Void Volume Index.

As used herein, a wet-pressed tissue web or sheet is a creped paper web suitable for use as a facial tissue, bath tissue, kitchen towel, dinner napkin or the like which is made by a wet-pressing tissue making process such as those well known in the tissue making art. A common feature of all wet-pressing processes is that after formation, the wet web is mechanically pressed, typically by using a pressure roll to press the wet web between a papermaking felt and the dryer surface (such as a Yankee dryer), to squeeze out some of the water from the web and adhere it to the dryer surface prior to final drying.

Papermaking fibers for making the tissue webs of this invention include any natural or synthetic fibers suitable for the end use products listed above including, but not limited to: nonwoody fibers, such as abaca, sabai grass, milkweed floss fibers, pineapple leaf fibers; softwood fibers, such as northern and southern softwood kraft fibers; hardwood fibers, such as eucalyptus, maple, birch, aspen, or the like. Because of commercial availability, softwood and hardwood fibers are preferred.

As used herein, a layered headbox is a headbox having one or more headbox dividers which create separate flow channels or layers of papermaking stock issuing from the headbox. The dividers need not extend beyond the headbox lips, but such extended dividers are preferred in order to preserve layer purity by minimizing intermixing of the layers. As defined above, the stock layer (an aqueous suspension of papermaking fibers) within the divided headbox which directly contacts the forming fabric is referred to herein as the "first" stock layer. This is the stock layer through which most or all of the water in the newly-formed web must pass as the web is dewatered through the forming fabric. Superposed on top of the first stock layer, as the papermaking stock leaves the headbox for deposition onto the forming fabric, are one or more successive stock layers of fiber suspensions, the number of which depends on the number of headbox dividers. Each of these successive superposed stock layers is generally referred to herein as a "second" aqueous suspension of papermaking fibers, unless the individual superposed stock layers are otherwise identified. There can be two, three, four or more distinct stock layers, although two or three are preferred for practical commercial reasons.

For embodiments of this invention where there are three or more stock layers, the consistencies of each stock layer can be adjusted to provide a wide range of consistency ratios relative to the consistency of the first stock layer. It is preferable that the consistencies of successive stock layers decrease when progressively going from the first stock layer to the second stock layer to the third stock layer and so on. However, it is within the scope of this invention that successive stock layers have the same consistency. In a three-layer stock system, the second and third stock layers can have the same consistency provided they are less than the consistency of the first stock layer. Alternatively, the first and second stock layers can have the same consistency while the consistency of the third stock layer is less than that of the first two.

It is important to note that the fiber composition of the stock layers can be the same or different. If the fiber composition of all of the stock layers is the same, regardless of the number of stock layers, a blended tissue product having improved formation will result. However, additional product benefits can be obtained if the fiber compositions of the stock layers are different. In this regard, in a two layer stock system for example, the first stock layer can comprise primarily hardwood fibers and the second stock layer can comprise primarily softwood fibers, although the reverse can also be used. The preferred layer compositions may vary depending on the particular type of former being used and the desired product attributes.

For example, using a crescent former where the web is formed between a fabric and a felt, a preferred manner of operating would be to place the hardwood fibers on the fabric side at relatively higher consistency than the strength-developing softwood fibers, which would be placed on the roll side. This configuration results with the hardwood fibers being placed against the Yankee dryer during creping and subsequently being plied into a two-ply product with the hardwood fibers on the outside surfaces of the product. Alternatively, the softwood fibers can be placed on the forming wire at relatively higher consistency and the hardwood fibers placed on the roll side at relatively lower consistency. In this mode, the softwood, or strength, fibers are placed against the Yankee during creping. During the plying process, the hardwood fibers can be placed on the outside of the multi-ply product to produce a soft tissue. An advantage of this configuration is an increase in sheet opacity at comparable basis weights.

In a suction breast roll former, the more dilute side of the sheet is the top side or the side against the "roof" of the headbox. The side with the higher consistency, be it hardwood or softwood, is placed onto the forming fabric. Similarly, in the "S" wrap twin wire former, the higher consistency side would be first laid onto the fabric side while the lower consistency would be placed on the roll side. In all of the formers mentioned above, the higher consistency side is ultimately placed in contact with the surface of the Yankee dryer.

By way of contrast, when using a twin wire "C" former, the roll side of the formed sheet, which is the more dilute side, is placed against the surface of the Yankee dryer. A preferred mode of operation would be to place the hardwood layer on the roll side of the former and ply the hardwood fibers on the outside of the product. Alternatively, the hardwood fibers can be placed on the fabric side and the softwood fibers on the roll side, the softwood fibers being the relatively more dilute layer. In this mode the softwood fibers are against the surface of the Yankee during creping, but the plying is carried out such that the hardwood fibers are still on the outside of the product.

The "Formation Index" is measured using a digital image analysis system with a minimum pixel density of 512 (horizontal) by 480 (vertical) and 8 bit resolution (giving 256 gray levels). Several commercial systems are available with these specifications including the Zeiss IBAS image analysis system (available from Carl Zeiss, Inc. in Thornwood, N.Y.) and the Leica/Cambridge 900 Series image analysis system (available from Leica, Inc. in Deerfield, Ill.). Alternatively, an image analyzer suitable for the measurement of the Formation Index can be constructed from a "386 Class" personal computer containing a video frame grabber card such as the Imaging Technology VP1400-KIT- 640-U-AT (manufactured by Imaging Technology Inc. of Bedford, Mass.) or equivalent frame grabbers from Data Translation (of Boston, Mass.) or other vendors. Such personal computer-based systems are most effectively operated using specialized image analysis software such as Optimas (available from Optimas Inc., Edmonds, Wash.). Many other such software packages are available for the different frame grabber cards.

Whatever image analysis system is used, a video camera system is used for image input. Either image tube cameras or solid state cameras such as those utilizing Charge Coupled Devices may be used. The chosen camera must have a gamma value of between 0.9 and 1.0. One such camera is a Dage Model 68 camera containing a Newvicon sensing tube (available from Dage MTI, Michigan City, Ind.).

A 35 mm. focal length lens is used with the camera. Any high quality lens may be used, such as the Nikon Nikkor 35 mm., f/2 autofocus lens (manufactured by Nikon, Inc., Japan). The lens is attached to the camera through suitable adapters. Typically, the lens is operated with its aperture set to f/5.6.

The camera system views a tissue sample sandwiched between a plate of diffuser plastic and window glass. This sandwich is placed on the center of a light box having dimensions of greater than 8 inches in each direction. Whatever light box is used, it must have a uniform field of Lambertian (diffuse) illumination of adjustable intensity. The method of intensity adjustment must not change the color temperature of the illumination. One appropriate light box is the ChromoPro Model 65 illuminator with optional diffuser table (available from Byers Photo Equipment Co. of Portland, Oreg.).

Specifically, samples for the Formation Index are single-ply tissue sheets cut to 4-inch by 4-inch squares, with one side aligned with the machine direction of the test material. Each specimen is placed on a square 4-inch by 4-inch piece of nominally ⅛-inch thick Plexiglas MC acrylic sheet (available from Rohm and Haas, Philadelphia, Pa.) such that the side of the tissue sheet that contacted the Yankee dryer during manufacture is facing up, away from the acrylic sheet. The tissue sheet is then covered with a 4-inch by 4-inch by nominally ⅛-inch thick piece of window glass containing no visible scratches or optical imperfections.

The specimen "sandwich" is set, glass side up, on the light box so that the center of the sandwich is aligned with the center of the illumination field. All other natural or artificial room light is extinguished. The camera is adjusted so that its optical axis is perpendicular to the plane of the tissue sheet and so that its video field is centered on the center of the specimen sandwich. The machine direction of the specimen is aligned with the vertical direction of the camera field. The camera is then positioned along its optical axis until its entire field of view contains exactly two inches of the specimen in the horizontal direction. The camera is focused so that the resulting picture contrast, measured as the standard deviation of the pixel array formed by digitization of the image, is maximized.

Next, the sample sandwich is replaced with a 4-inch by 4-inch piece of the acrylic sheet that does not have a specimen mounted. This acrylic sheet also is placed in the center of the light box, but it is not covered with a piece of window glass. The light box intensity is adjusted so that the mean value of the pixel array formed by digitization of this image averages 160 gray levels, plus or minus 0.4 gray levels. 32 frames of this image are then averaged into the frame grabber memory as a shading correction image.

The specimen sandwich is again placed on the light box, in the same position and alignment as it was previously. The light box illumination is adjusted so that the mean value of the resulting pixel array representing the tissue picture is again 160 gray levels plus or minus 0.4 gray levels. 32 frames of the tissue image are averaged into another part of the frame grabber memory.

The Formation Index is calculated by correcting the tissue image for light box shading, preferably by using an additive shading correction procedure. A precursor of the Formation Index is then calculated from the variance of the shading corrected pixel array as:

$$\text{Precursor}=(16/[\text{pixel array variance}])$$

Image analyzer systems have intrinsic response differences due to design differences between various manufacturers and also due to normal component variation. Therefore, an image analysis system must be calibrated against a set of fourteen known tissue standards before the final Formation Index can be calculated. These tissue standards (available from Kimberly-Clark Corporation, Neenah, Wisc.) are tested on a "standard" image analysis system and are individually rated as to the expected value of the Formation Index along with its standard deviation when tested on appropriate equipment. The list of standards used for calibration are listed below:

| Standard Identification | Nominal Formation Index |
|---|---|
| FSTD-1 | 81 |
| FSTD-2 | 85 |

-continued

| Standard Identification | Nominal Formation Index |
|---|---|
| FSTD-3 | 91 |
| FSTD-4 | 93 |
| FSTD-5 | 101 |
| FSTD-6 | 102 |
| FSTD-7 | 109 |
| FSTD-8 | 106 |
| FSTD-9 | 101 |
| FSTD-10 | 97 |
| FSTD-11 | 89 |
| FSTD-12 | 80 |
| FSTD-13 | 160 |
| FSTD-14 | 180 |

The image analysis system is calibrated against these tissue standards by measuring each standard on the system and obtaining a Precursor value. Each standard is individually measured at least three times and the average Precursor value for each standard is used as the independent variable in a least squares linear regression utilizing the specified standard's Formation Index as the dependent variable. If the equipment is properly set up, the coefficient of determination for this regression should be greater than 0.95.

The linear regression procedure gives a slope value, which is herein referred to as the "m" value, and an intercept value, which is herein referred to as the "b" value. The Formation Index can be calculated for any specimen by measuring its Precursor value and using the following equation.

$$(\text{Formation Index})=m*\text{Precursor}+b$$

The image analysis system must have new values of the calibration coefficients, m and b, calculated occasionally. While the frequency of this calibration depends, in general, on the stability of the image analysis system, best measurement of the Formation Index is made when calibration is carried out at each power-up of the formation analyzer system, or on a daily basis, if the image analyzer is left powered-up.

As used herein, "Void Volume" is determined by saturating a sheet with a nonpolar liquid and measuring the volume of liquid absorbed. The volume of liquid absorbed is equivalent to the void volume within the sheet structure. The Void Volume is expressed as grams of liquid absorbed per gram of fiber in the sheet. More specifically, for each single-ply sheet sample to be tested, select 8 sheets and cut out a 1 inch by 1 inch square (1 inch in the machine direction and 1 inch in the cross-machine direction). For multi-ply product samples, each ply is measured as a separate entity. Multiply samples should be separated into individual single plies and 8 sheets from each ply position used for testing. Weigh and record the dry weight of each test specimen to the nearest 0.001 gram. Place the specimen in a dish containing POROFIL™ pore wetting liquid of sufficient depth and quantity to allow the specimen to float freely following absorption of the liquid. (POROFIL™ liquid, having a specific gravity of 1.875 grams per cubic centimeter, available from Coulter Electronics Ltd., Northwell Drive, Luton, Beds., England; Part No. 9902458.) After 10 seconds, grasp the specimen at the very edge (1–2 millimeters in) of one corner with tweezers and remove from the liquid. Hold the specimen with that corner uppermost and allow excess liquid to drip for 30 seconds. Lightly dab (less than ½ second contact) the lower corner of the specimen on #4 filter paper (Whatman Ltd., Maidstone, England) in order to remove any excess of the last partial drop. Immediately weigh the specimen, within 10 seconds, recording the weight to the nearest 0.001 gram. The Void Volume for each specimen, expressed as grams of POROFIL per gram of fiber, is calculated as follows:

$$\text{Void Volume}=[(W_2-W_1)/W_1],$$

wherein

"$W_1$" is the dry weight of the specimen, in grams; and

"$W_2$" is the wet weight of the specimen, in grams.

The Void Volume for all eight individual specimens is determined as described above and the average of the eight specimens is the Void Volume for the sample.

DETAILED DESCRIPTION OF THE DRAWING

Figure 1:
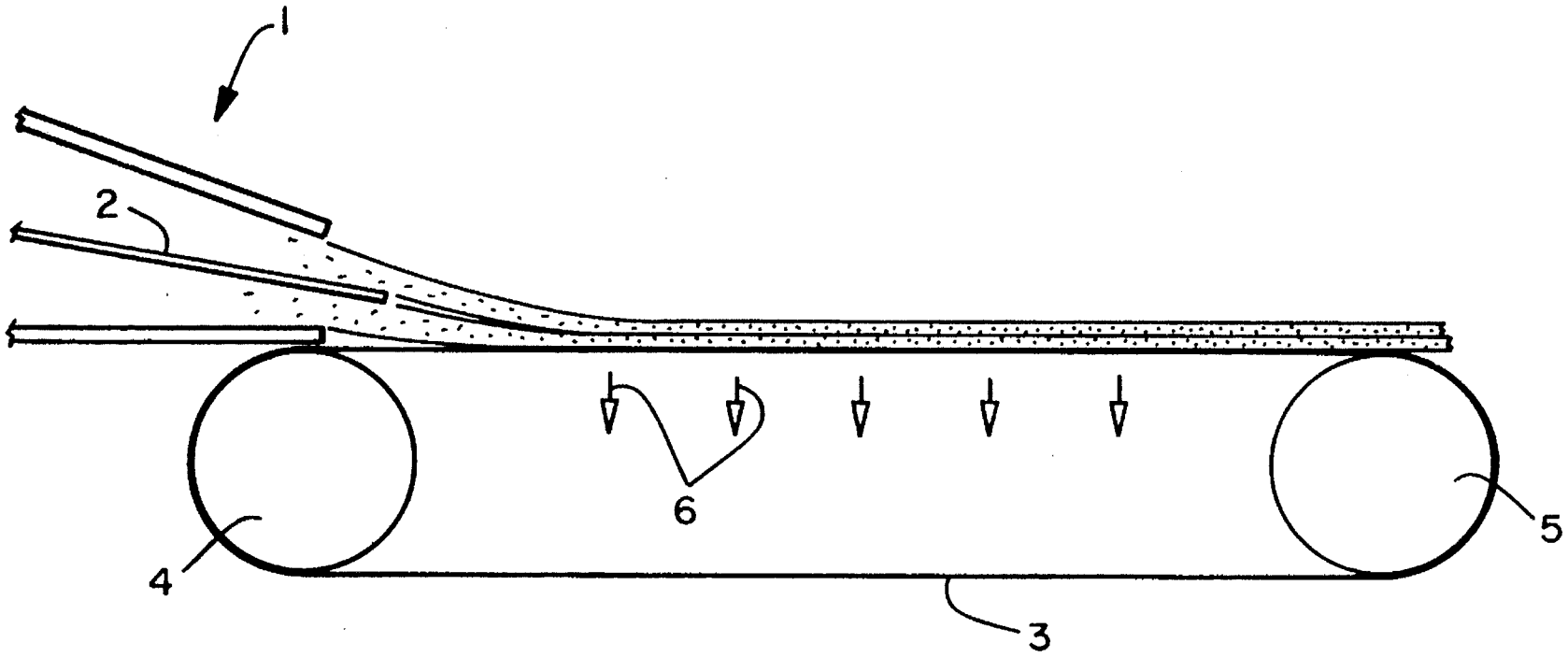
FIG. 1 is a schematic diagram of the forming zone of a typical tissue machine, illustrating the formation of multiple layers in accordance with this invention.

Referring to FIG. 1, the invention will be described in greater detail. FIG. 1 is a schematic diagram of a layered forming process illustrating the sequence of layer formation. Shown is a two-layered headbox 1 containing a headbox layer divider 2 which separates the first stock layer (the lower or bottom layer) from the second stock layer (the upper or top layer). The two stock layers each consist of a dilute aqueous suspension of papermaking fibers having different consistencies. In general, the consistencies of these stock layers will be from about 0.04 percent to about 1 percent. An endless travelling forming fabric 3, suitably supported and driven by rolls 4 and 5, receives layered papermaking stock issuing from the headbox and retains the fibers thereon while allowing some of the water to pass through as depicted by the arrows 6. In practice, water removal is achieved by combinations of gravity, centrifugal force, and vacuum suction depending on the forming configuration. As shown, the first stock layer is the stock layer which is first to make contact with the forming fabric. The second stock layer (and any successive stock layers if a headbox having more than one divider is utilized) is the second-formed layer and is formed on top of the first layer. As shown, the second stock layer never contacts the forming fabric. As a result, the water in the second and any successive layers must pass through the first layer in order to be removed from the web by passing through the forming fabric. While this situation might be considered to be disruptive of the first layer formation because of all the additional water which is deposited on top of the first stock layer, it has been found that diluting the second and successive stock layers to lower consistencies than that of the first stock layer provides substantial improvements in the formation of the second and successive layers without detriment to the formation of the first layer.

Figure 2:
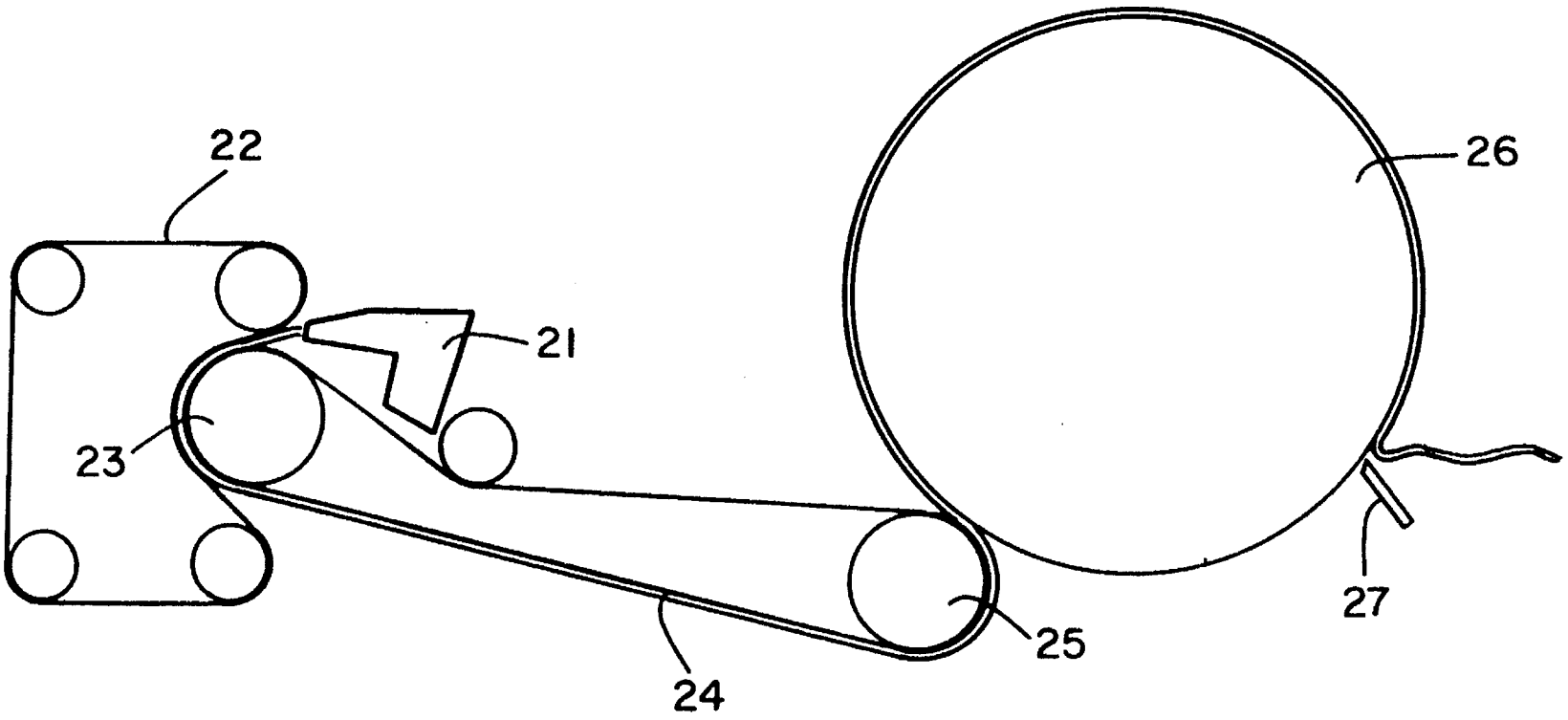
FIG. 2 is a schematic diagram of a tissue making process using a crescent former in accordance with this invention.

FIG. 2 is a schematic flow diagram of the method of this invention placed in context of a conventional tissue making process. The specific formation mode illustrated is commonly referred to as a crescent former. Shown is a layered headbox 21, a forming fabric 22, a forming roll 23, a papermaking felt 24, a press roll 25, a Yankee dryer 26, and a creping blade 27. Also shown, but not numbered, are various idler or tension rolls used for defining the fabric runs in the schematic diagram, which may differ in practice. As shown, a layered headbox 21 continuously deposits a layered stock jet between the forming fabric 22 and the felt 24, which is partially wrapped around the forming roll 23. Water is removed from the aqueous stock suspension through the forming fabric by centrifugal force as the newly-formed web traverses the arc of the forming roll. As the forming fabric and felt separate, the wet web stays with the felt and is transported to the Yankee dryer.

At the Yankee dryer, the creping chemicals are continuously applied on top of the existing adhesive in the form of an aqueous solution. The solution is applied by any convenient means, preferably using a spray boom which evenly sprays the surface of the dryer with the creping adhesive solution. The point of application on the surface of the dryer is immediately following the creping doctor, permitting sufficient time for the spreading and drying of the film of fresh adhesive.

The wet web is applied to the surface of the dryer by means of a pressing roll with an application force of about 200 pounds per square inch (psi). The incoming wet web is nominally about 10 percent consistency (range from about 8 to about 20 percent) at the time it reaches the pressure roll. Following the pressing or dewatering step, the consistency of the web is at or above about 30 percent. Sufficient Yankee dryer steam power and hood drying capability are applied to this web to reach a final moisture content of 3 percent or less, preferably 2.5 percent or less. The sheet or web temperature immediately preceding the creping blade, as measured by an infra-red temperature sensor, is preferably about 235° F.

Under these severe drying conditions, the adhesive bond between the web and the Yankee dryer is very high—so high that under normal creping operations the sheet could not be scraped off the dryer and would "wrap" the dryer, a severe condition requiring the machine be shut down and restarted. To avoid this situation, conventional creping understanding would call for the addition of a "release" material to permit removal of the sheet. However, this releasing action also causes the creping of the sheet to become coarse and the resulting tissue softness declines considerably. Traditional understanding would then call for less adhesive and lower creping temperatures so that less release material would be needed and better creping could be obtained. However, doing so limits both the softness and bulk of the resulting tissue. These pitfalls are avoided by the creping method of this invention. It is theorized that the creping adhesive of this invention forms two functionally different layers on the surface of the Yankee dryer. The inner or subsurface layer is a very hard layer which provides an inner surface on which the creping blade rides and also provides protection for the dryer surface. This layer is highly crosslinked as a result of the high dryer surface temperatures and the presence of calcium in the hard water being removed from the wet web. The second or outer layer of creping adhesive is softer due to the presence of the plasticizer which is believed to impair crosslinking. The lack of crosslinking prevents the outer layer of adhesive from getting too hard, yet without reducing the adhesive forces holding the sheet to the Yankee dryer. The outer layer of the adhesive coating remains resilient and softer than either the inner layer or the fibrous web, thus providing the creping blade with a zone in which to run that is below the surface of the web.

The presence of the plasticizer in the second or outer adhesive layer has little or no impact on the level of adhesion of the web to the dryer surface, but has a very significant impact on the amount of fibers left on the dryer surface. This behavior is believed to result from the action of the plasticizer, which allows the creping blade to run in the "softest", most lubricated adhesive layer on the dryer, which is just below the fibers on the outside of the sheet. This mode of operation is believed to be responsible for the very low dust levels generated because few, if any, of the fibers are "cut" or torn loose from the surface of the web during creping. All of the creping action is instead directed toward compression of the sheet in the machine direction of the web. The very high adhesion levels prevent the sheet from "popping" off the surface of the dryer, an action responsible for the coarse creping observed in typical creping processes. Because the adhesion forces are greater than the tensile strength of the uncreped sheet, this sheet cannot be "peeled" off the dryer. The tremendous compressive forces incurred at the creping blade open the sheet up so effectively that characteristics similar to throughdried sheets are obtained. However, because this action is also done in an extremely uniform fashion, with the inner strength layer of the tissue web preferably away from the surface of the dryer and therefore somewhat "insulated" from this creping action, less strength development is required before creping than with conventional creping methods. These lower initial strengths also contribute significantly to better sheet break-up.

Surprisingly, the softness properties of the creped tissues of this invention are relatively insensitive to the fiber composition of the layer attached to the dryer surface. Again, the very aggressive, very uniform, creping so effectively breaks up this surface layer without "cutting" fibers that few tactile differences can be detected. Consequently a significant amount of "strength" (softwood) fibers can be placed in this dryer side surface layer of the tissue using this invention, with no detrimental effects on softness.

Figure 3:
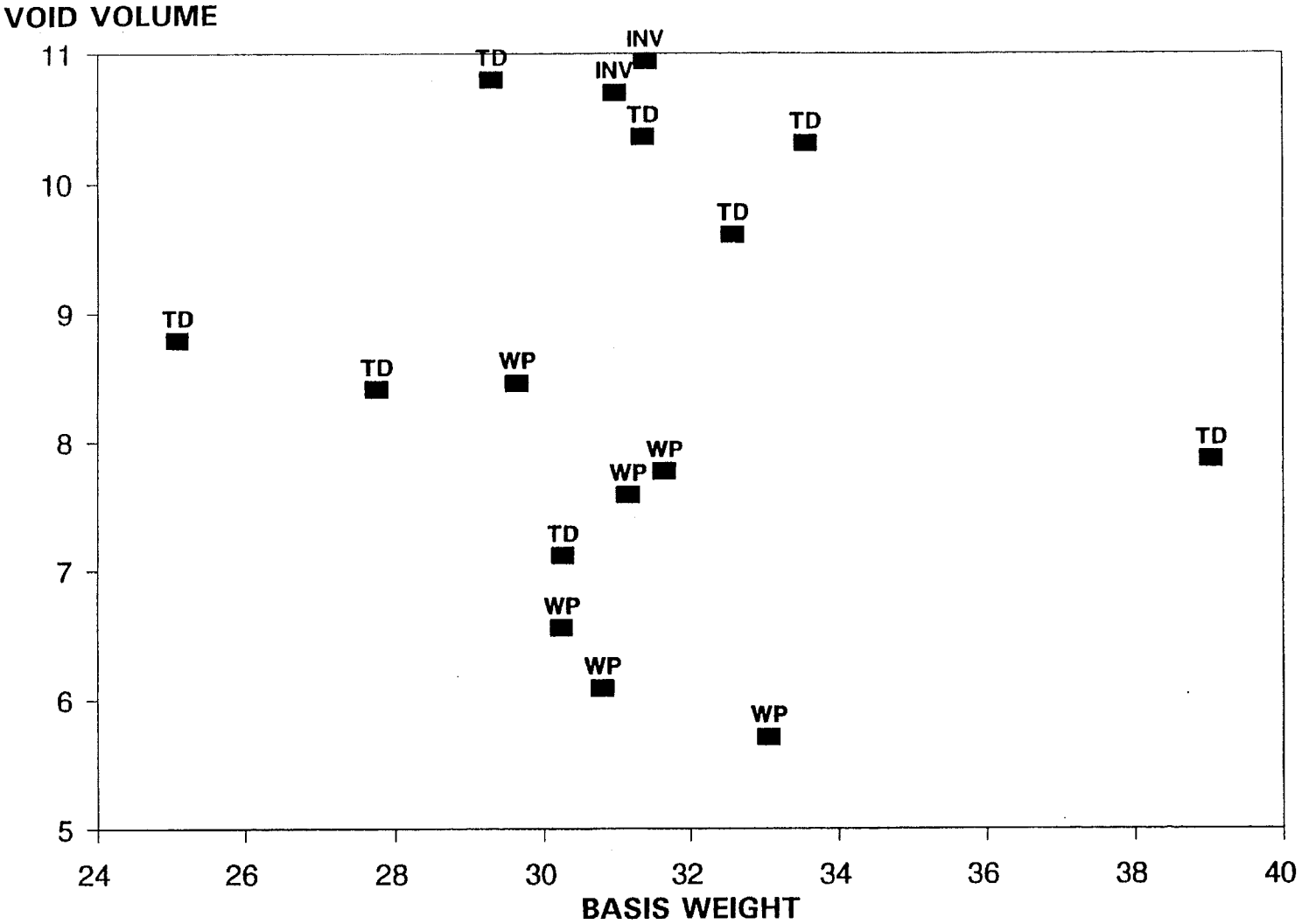
FIG. 3 is a plot of Void Volume as a function of basis weight for two-ply wet-pressed and throughdried tissues, illustrating an advantage of the method of this invention as applied to wet-pressed tissue products.

FIG. 3 is a plot of Void Volume (expressed as grams of POROFIL liquid per gram of fiber) versus basis weight (expressed as grams per square meter) for a number of two-ply tissue products, illustrating how the method of this invention can transform a layered wet-pressed product into a throughdried-like product in terms of fiber structure. As will be illustrated hereinafter, increases in Void Volume correlate with improved softness. Shown in the plot of FIG. 3 are a number of commercial wet-pressed tissue products, labelled "WP", and several commercial throughdried tissue products, labelled "TD". The wet-pressed tissue products made in accordance with this invention are labelled "INV". As shown, the wet-pressed tissue products of this invention have a Void Volume of about 11, which is equivalent to the Void Volume of the throughdried products.

Figure 4:
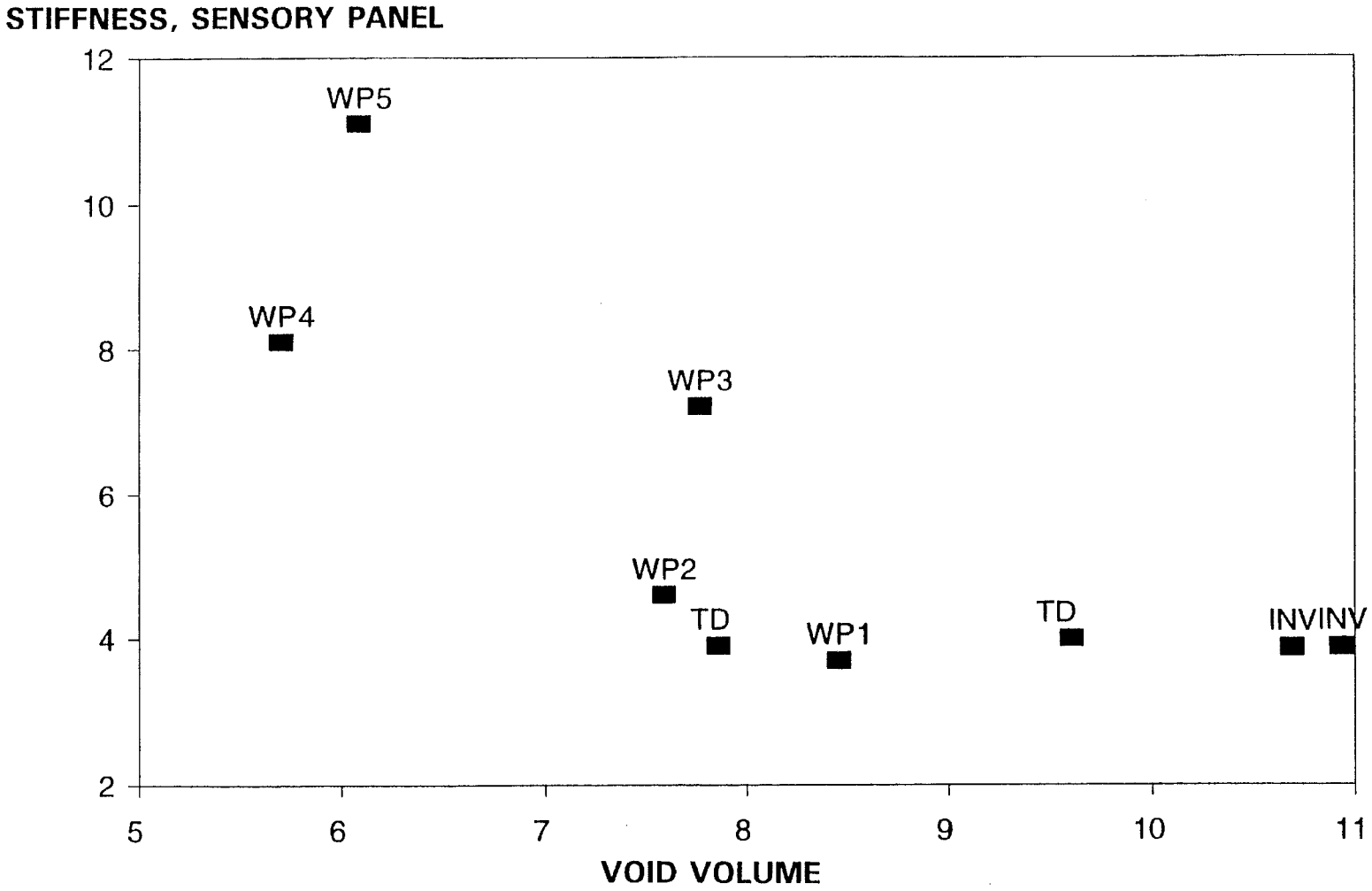
FIG. 4 is a plot of Stiffness, as determined by a trained sensory panel, as a function of Void Volume, illustrating decreasing stiffness (and hence increasing softness) with increasing Void Volume, as well as illustrating the low stiffness of the products of this invention.

FIG. 4 is a plot of sheet stiffness, as determined by a trained sensory panel, as a function of the Void Volume for a number of tissue samples. As shown, the stiffness of the products of this invention, designated by the points labelled "INV", is very low relative to most of the other wet-pressed products.

Figure 5:
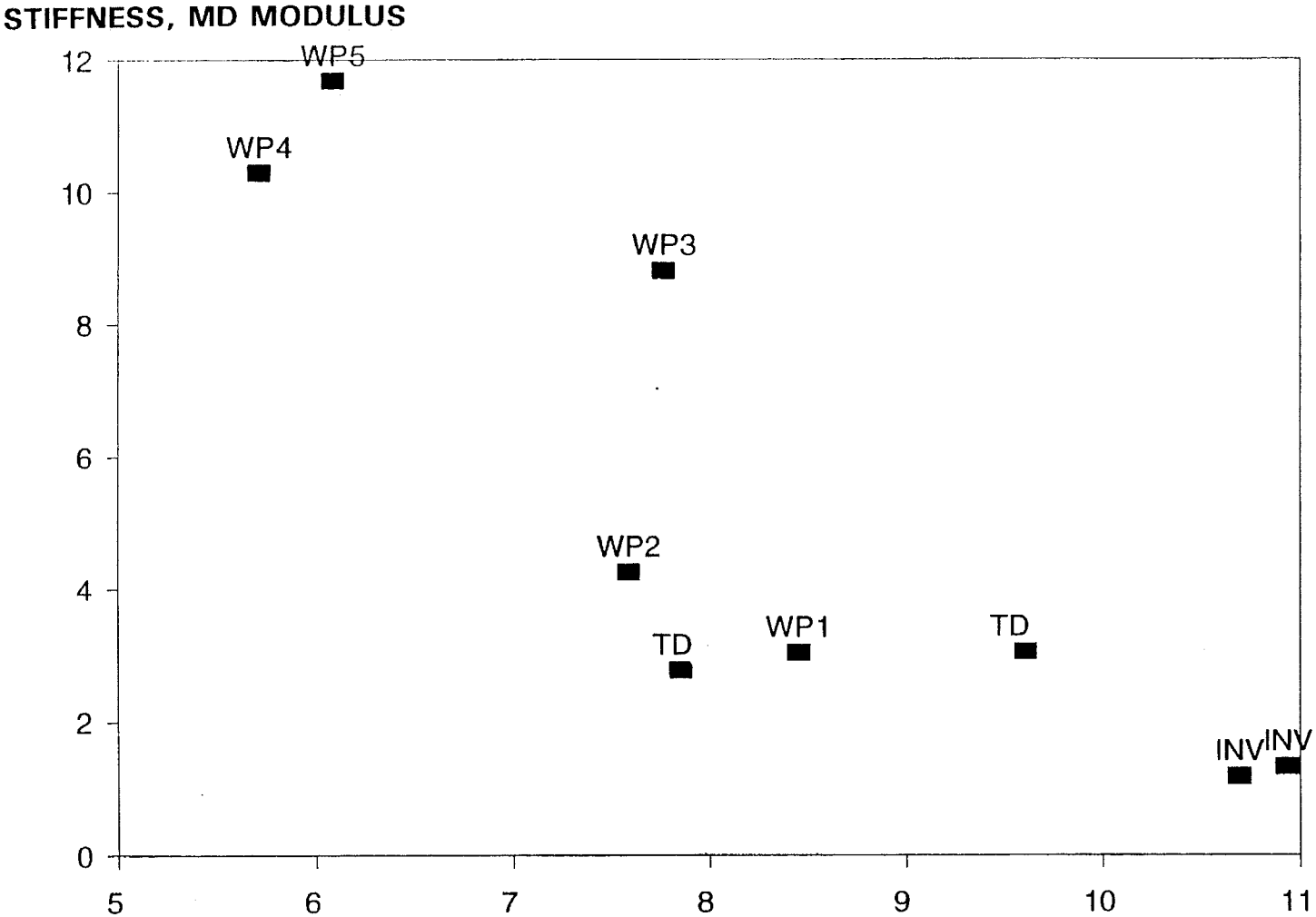
FIG. 5 is similar to FIG. 4 and is a plot of Stiffness, as represented by MD (machine direction) Modulus, as a function of Void Volume, further illustrating the low stiffness of the products of this invention.

FIG. 5 is a plot similar to that of FIG. 4, but substituting MD Modulus for the sensory panel measurement of stiffness. The relationship is generally the same, with the sheets of this invention having a significantly lower MD Modulus than all of the conventional wet-pressed samples tested.

Figure 6:
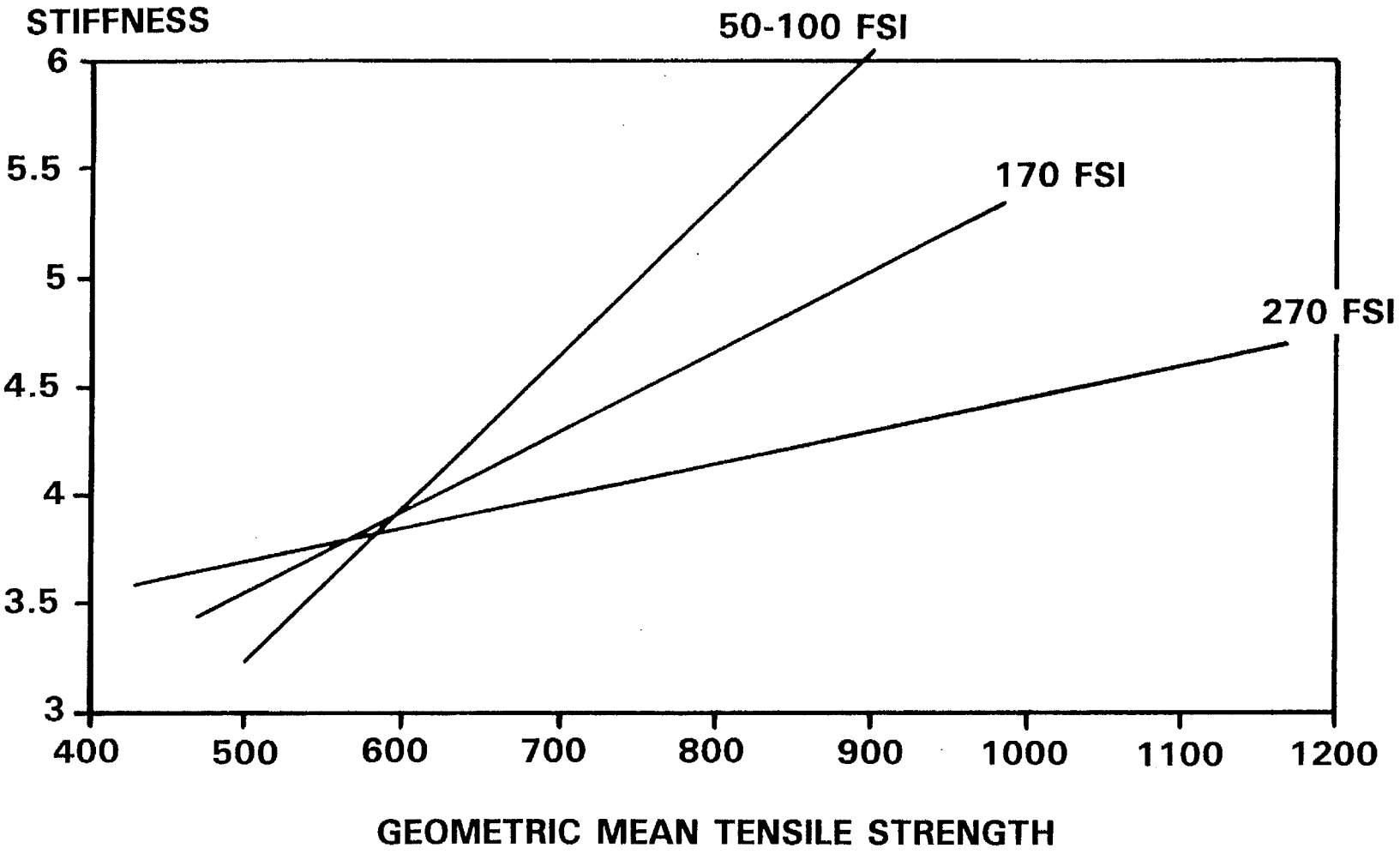
FIG. 6 is a plot of Stiffness, as determined by a trained sensory panel, as a function of geometric mean tensile strength for tissues made using forming fabrics having different fiber support indexes, illustrating the improved relationship of stiffness and strength as the fiber support index is increased.

FIG. 6 is a plot of stiffness as a function of strength for tissues made with forming fabrics having different fiber support indexes. As previously mentioned, it has been discovered that increasing the fiber support index of the forming fabric flattens the slope of the curve, thus reducing the stiffness of the products of this invention for a given level of strength.

EXAMPLES

EXAMPLE 1

In order to further illustrate the invention, a creped sheet was made using the crescent former illustrated in FIG. 2. More specifically, aqueous suspensions of 100% virgin papermaking fibers, one suspension 100% hardwood and one 100% softwood, were prepared containing about 0.1 weight percent fibers. The hardwood portion of this furnish, representing half the total sheet weight, was fed to the forming zone, contacting the wire side of the forming unit, at about 0.15 weight percent fibers. Simultaneously delivered to the roll side of the forming unit was the softwood portion, representing half the total sheet weight, in a suspension containing about 0.075 weight percent fibers. Both of these suspensions were delivered from the same headbox but were kept separated by an extended divider sheet until just before contacting the forming zone. The headbox used was of three chamber design, two of which were devoted to delivering the lower consistency softwood fibers while one chamber was devoted to the higher consistency hardwood. The forming fabric used was an Albany 94M, a typical tissue weight forming fabric having a fiber support index of 172, travelling at a speed of about 3000 feet per minute. The felt was an Albany Duravent, a typical felt used in tissue production. The sheet was delivered to the pressure roll and Yankee dryer at about 10 weight percent consistency.

Prior to the application of the wet sheet to the Yankee dryer, a dilute creping adhesive mixture of polyvinyl alcohol, Kymene, and Quaker 2008 was applied via a spray boom operating over a pressure range of 60–120 psi, using 65-0033 nozzles spaced to provide a triple overlap spray pattern. A typical adhesive blend comprises, on a dry basis, about 40 weight percent polyvinyl alcohol, 40 weight percent Kymene, and 20 weight percent Quaker 2008. This mixture is typically added in an amount that ranges from about 2 to about 6 pounds of mixture for each ton of fiber creped off the Yankee dryer.

The sheet is then pressed to the Yankee dryer. The pressing was done with a relatively wide nip with an applied pressure of about 200 pounds of loading force per square inch of contact on the Yankee dryer. Such nips are obtained using a roll covering of about 35 P&J hardness and having loaded the nip to about 500 pounds per lineal inch across the Yankee dryer.

Following attachment of the sheet to the Yankee dryer the consistency of the web was at about 40 weight percent fibers. The Yankee and hood drying systems were set to achieve a final sheet dryness of less than 2.5 percent. Control of this dryness was achieved by measuring the temperature of the sheet on the Yankee just prior to the creping blade. Using an emissivity setting of 0.9, the best temperatures for this creping were in the range of from about 210° F. to about 240° F.

The sheet was then creped off the Yankee dryer using a typical metal creping blade set up with an 80° to 90° creping pocket angle so as to provide efficient sheet breakup without undue loss of sheet strength. The resulting sheet was then wound into a softroll and exhibited the following characteristics: basis weight, 15 grams per square meter (gsm); geometric mean tensile strength, 650 grams per 3 inches of width (grams) tested with two plies together to simulate an actual tissue product; Formation Index of 180; a Void Volume of about 11.2; and a caliper of 0.0135 inches tested with two sheets plied together such that creped sides are out.

During the course of developing this invention, many samples were made at varying basis weights, fiber types and strength levels. Finished product samples made from these sheets were then subjected to softness testing. It was noted that softness was apparently less sensitive to strength than historically observed with normal creping. Calculations showed that historical strength/softness data showed a slope of 0.007 points of softness reduction with each 1 gram strength increase. However, using the method of this invention and a forming fabric having a fiber support index of 172, this slope was reduced to 0.0032 points of softness reduction.

EXAMPLE 2

Creped tissue sheets were made as described in Example 1 except that the 94M forming fabric was replaced with a Lindsay 2164 forming fabric having a fiber support index of 261. All other conditions were replicated as best as possible. Over a wide range of tensile strengths it was observed that the sensitivity of the softness to the tensile strength was again reduced. The slope was reduced to 0.0015 units of softness loss per unit of strength gained. Formation index values were maintained in the 160–180 range, basis weight at the 15 gsm level, Void Volume ranged from about 9.8 to about 11.7, and caliper readings were in the 0.0110–0.0130 inch range.

EXAMPLE 3

A creped sheet made as described in Example 1 except that the relative positions of the hardwood and softwood fibers were changed. The same hardwood fibers were delivered to the headbox on the roll side of the former at the relatively lower consistency while the softwood fibers were delivered to the former on the wire side of the former at the relatively higher consistency. All other conditions remained the same except for some slight adjustments in the creping chemicals applied to the Yankee dryer to account for the different adhesive properties between the hardwood and softwood fibers. Typically such adjustments included a reduction in the overall amounts applied or an increase in the amount of Quaker 2008 in the mixture. The resulting properties of the base sheet were as follows: basis weight, 15 gsm; geometric mean tensile strength, 600 grams; Formation Index of 160; Void Volume of 10.5; and a caliper of 0.0125 inches tested with two sheets plied together such that the uncreped sides are out.

EXAMPLE 4

For comparison, several creped sheets were made in a conventional layered mode in which the same fibers as in Example 1 were delivered to the headbox at 0.1 weight percent consistency. In this case both the hardwood and softwood portions, each representing half the total sheet weight, were delivered to the forming zone at the same 0.1 weight percent consistency. The softwood fibers were formed on the roll side of the sheet while the hardwood fibers were formed on the wire side of the sheet. In this case, two extended dividers separated the three chambers of the headbox. Other conditions were maintained the substantially the same as that in Example 1, except the sheet consistency when creped was 95.5 percent. The resulting properties of the sheets are as follows: basis weight, 15–18 gsm; geometric mean tensile strength, 650–850 grams; Formation Index, 120–140; Void Volume, 7–8; and caliper of 0.0075–0.0095 inches tested with two sheets plied together such that the creped sides are out.

EXAMPLE 5

To compare the method of this invention with a more conventional method of producing soft tissues, a sample tissue was produced on a layered crescent former using similar consistencies in both layers, a forming fabric having a fiber support index of 115 (Albany 78S), a creping adhesive as described in Example 1, and creping at a conventional moisture content of 4.5 percent (95.5 percent consistency). For comparison, the forming fabric was then changed to one having a fiber support index of 172 (Albany 94M) and the tissue was produced under conditions equivalent to those of Example 1 with the creping moisture reduced to less than 2.5 percent. The following table summarizes some of the product properties. As set forth in the Table, "tensile strength" is geometric mean tensile strength, expressed in grams per 3 inches of sample width; "Void Volume" is expressed in grams per gram of fiber; "Softness" is a sensory panel evaluation based on a scale of 1 to 10, with 10 being the most soft and 1 being the least soft; "Caliper" is expressed in inches; "Basis Weight" is expressed in grams per square meter; and the "Dust on Sheet" is expressed as a fiber count and is determined by using a GLF Fluff Tester as described in U.S. Pat. No. 5,227,242 to Walter et al. issued Jul. 13, 1993, which is herein incorporated by reference. (The lint (dust on sheet) counting method is described beginning at column 5, line 48.)

TABLE

| | Conventional | Invention |
|---|---|---|
| Fiber Support Index | 115 | 172 |
| Tensile Strength | 754 | 650 |
| Void Volume | 9.5 | 11 |
| Formation Index | 110 | 154 |
| Softness | 8 | 8 |
| Caliper | 0.0076 | 0.0135 |
| Basis Weight | 30.4 | 28.0 |
| Dust on Sheet | 11,670 | 3,079 |

As shown, the product produced by the method of this invention exhibits greater caliper and less dust at equivalent softness due to the superior formation and more uniform creping.

It will be appreciated that the foregoing examples, given for purposes of illustration, are not to be construed as limiting the scope of this invention, which is defined by the following claims and all equivalents thereto.

We claim:

1. A method for making soft tissue comprising: (a) forming a wet tissue web using a layered headbox in which first and second stock layers having different consistencies, separated by a headbox divider, are continuously deposited onto an endless forming fabric having a fiber support index of about 170 or greater to form a wet web such that the second stock layer is superposed on top of the first stock layer and the first stock layer directly contacts the forming fabric, wherein the ratio of the consistency of the second stock layer to the consistency of the first stock layer is about 0.95 or less; (b) carrying the wet tissue web on a papermaking felt and pressing the wet web between the felt and the surface of a dryer coated with a creping adhesive to partially dewater the web and adhere it to the surface of the dryer, said creping adhesive comprising a plasticizer and a thermosetting cationic polyamide resin; (c) drying the dewatered web to a consistency of 97.5 percent or greater at a web temperature of about 200° F. or greater; and (d) creping the dried web.

2. The method of claim 1 wherein the consistency ratio is about 0.7 or less.

3. The method of claim 1 wherein the consistency ratio is about 0.5 or less.

4. The method of claim 1 wherein the consistency ratio is from about 0.1 to about 0.7.

5. The method of claim 1 wherein the consistency ratio is from about 0.3 to about 0.5.

6. The method of claim 1 wherein there are only two stock layers.

7. The method of claim 1 further comprising a third stock layer superposed on top of the second stock layer, wherein the ratio of the consistency of the third stock layer to the consistency of the first stock layer is about 0.95 or less.

8. The method of claim 7 wherein the ratio of the consistency of the third stock layer to the consistency of the first stock layer is about 0.7 or less.

9. The method of claim 7 wherein the ratio of the consistency of the third stock layer to the consistency of the first stock layer is from about 0.7 to about 0.1.

10. The method of claim 1 wherein the papermaking fibers of the first stock layer are substantially the same as the papermaking fibers of the second stock layer.

11. The method of claim 10 wherein the papermaking fibers are a blend of softwood fibers and hardwood fibers.

12. The method of claim 1 wherein the papermaking fibers of the first stock layer are different from the papermaking fibers of the second stock layer.

13. The method of claim 1 wherein the papermaking fibers of the first stock layer are predominantly softwood fibers.

14. The method of claim 1 wherein the papermaking fibers of the first stock layer are predominantly hardwood fibers.

15. The method of claim 1 wherein the papermaking fibers of the first stock layer are predominantly softwood fibers and the papermaking fibers of the second stock layer are predominantly hardwood fibers.

16. The method of claim 1 wherein the fiber support index of the forming fabric is about 220 or greater.

17. The method of claim 1 wherein the fiber support index of the forming fabric is from about 170 to about 270.

18. The method of claim 1 wherein the web is dried at a temperature of about 220° F. or greater.

19. The method of claim 1 wherein the web is dried at a temperature of from about 220° F. to about 235° F.

20. The method of claim 1 wherein the creping adhesive further comprises polyvinyl alcohol.

21. The method of claim 20 wherein the fiber support index of the forming fabric is from about 170 to about 270.

22. The method of claim 21 wherein the consistency ratio is from about 0.1 to about 0.7.

23. The tissue web made by the method of claim 1.

* * * * *